US006189515B1

(12) United States Patent
Jamrog et al.

(10) Patent No.: US 6,189,515 B1
(45) Date of Patent: Feb. 20, 2001

(54) METHOD AND SYSTEM FOR RICH CONDITION VAPOR PURGE RESET BASED ON TANK VACUUM LEVEL CONDITION

(75) Inventors: James Richard Jamrog, Novi, MI (US); Douglas Alan Stukenborg, Durham, NC (US)

(73) Assignee: Ford Global Technologies, Inc., Dearborn, MI (US)

( * ) Notice: Under 35 U.S.C. 154(b), the term of this patent shall be extended for 0 days.

(21) Appl. No.: 09/307,442

(22) Filed: May 10, 1999

(51) Int. Cl.[7] ..... F02M 37/04
(52) U.S. Cl. ..... 123/520; 123/519
(58) Field of Search ..... 123/516, 518, 123/519, 520, 494, 698

(56) References Cited

U.S. PATENT DOCUMENTS 5,158,054 * 10/1992 Otsuka .
5,317,909 * 6/1994 Yamada et al. ..... 123/520
5,347,971 * 9/1994 Kobayashi et al. .
5,460,143 * 10/1995 Narita .
5,477,837 * 12/1995 Ikebuchi .
5,617,832 * 4/1997 Yamazaki et al. .
5,718,210 * 2/1998 Ito et al. ..... 123/520
5,816,223 * 10/1998 Jamrog et al. .
5,988,151 * 11/1999 Schneider ..... 123/698
6,047,688 * 4/2000 Duty et al. ..... 123/520

* cited by examiner

*Primary Examiner*—Thomas N. Moulis
(74) *Attorney, Agent, or Firm*—Jerome Drouillard

(57) ABSTRACT

A system and method for controlling the purging of vapor from a carbon canister based on identification of a vacuum loss in the manifold. The system and method of the present invention store target values for the tank pressure and purge duty cycle. A differential pressure between current system levels and target levels is calculated and compared to predetermined critical levels. If the currently calculated level exceeds a calibrated threshold value, a countdown timer is set and reset until the calculated differential drops below the threshold value. If the engine air mass drops below a critical calibrated air mass value before the timer has completed counting down, the purge flow is reset and slowly reintroduced to prevent rich engine air/fuel ratio conditions.

7 Claims, 6 Drawing Sheets

METHOD AND SYSTEM FOR RICH CONDITION VAPOR PURGE RESET BASED ON TANK VACUUM LEVEL CONDITION

TECHNICAL FIELD

The present invention relates to a system for resetting a vapor purge flow rate to prevent rich air/fuel conditions in an engine. More particularly, the present invention relates to a vapor purge flow rate reset system based on fuel tank vacuum level conditions.

BACKGROUND OF THE INVENTION

Government regulations concerning the release into the atmosphere of various exhaust emission constituents from automotive vehicles are becoming increasingly more stringent. As the regulations relating to emissions of oxides of nitrogen, carbon monoxide, and unburned hydrocarbons become more stringent, it is necessary to control the engine combustion process to avoid unnecessary instabilities and thus prevent formation of undesirable exhaust emissions.

Evaporative emission control is an important consideration in automotive design and necessitates that fuel vapor arising from the engine fuel system be drawn into the engine and burned. Because the fuel vapor can be combusted by the engine, an excessive flow of vapor may cause combustion instability, or perhaps even engine roughness or stalling.

U.S. Pat. No. 5,460,143 discloses an evaporative emissions control system in which a pressure transducer prevents purging of a carbon canister in the event that the fuel tank pressure falls to a negative value. U.S. Pat. No. 5,816,223 discloses a system in which purging is controlled not only when the tank pressure becomes negative, but in response to rapid fluctuations in the tank pressure whether at a positive or negative pressure. Rapid fluctuations may cause the air and fuel vapor entering the engine from the purge line of a carbon evaporative emission control canister to alter the combustion process.

Some fuel system vapor storage purge strategies rely on purge control valves that regulate a constant purge air/vapor mixture flow rate entering the engine for combustion. Constant flow regulation is attempted for vacuum levels ranging from very high to only a few inches of mercury below which the valve flow rate drops off. Under equilibrium conditions, fuel tank vacuum is equal to vapor storage canister system flow restriction. Vapor storage canister system flow restriction is a function of purge air flow through the system.

When the manifold vacuum falls below the constant purge flow vacuum levels, such as when the throttle is depressed for more engine power, significant purge flow can be lost. This loss in purge flow results in vapor storage canister flow restriction levels decreasing which, in turn, decreases the fuel tank vacuum levels. The tank vacuum levels decrease by drawing air into, or generating vapor within, the fuel tank vapor space to equalize system vacuums.

When the manifold vacuum increases, purge flow increases which creates higher vapor storage canister system flow restrictions. Fuel vapor mass must be drawn from the fuel tank vapor space in order to equalize the system vacuum levels. If a sufficiently large enough vapor mass is drawn from the fuel tank, undesirable rich engine air/fuel ratio conditions are created.

SUMMARY OF THE INVENTION

The present invention presents a system for preventing a rich engine air/fuel ratio condition from occurring when there is a change in the purge flow restriction based on engine conditions, i.e. when the throttle is depressed for more engine power.

The invention is advantageous in that it causes a change in the purge flow restriction based on engine operating conditions. According to the present invention, the foregoing and other objects and advantages are obtained by introducing a method for comparing the current system pressure against calibrated target levels. The method compares values for a predetermined period of time to determine whether or not the purge duty cycle needs to be reset and adjusted in order to prevent rich engine fuel/air conditions.

One object of the present invention is to identify a condition of high possibility of rich engine air/fuel ratio. Another object is to monitor engine air mass and determine if purge flow needs to be reset in order to avoid a rich engine air/fuel ratio condition.

Other objects and advantages of the invention will become apparent upon reading the following detailed description and appended claims, and upon reference to the accompanying drawings.

DESCRIPTION OF THE PREFERRED EMBODIMENT

Figure 1:
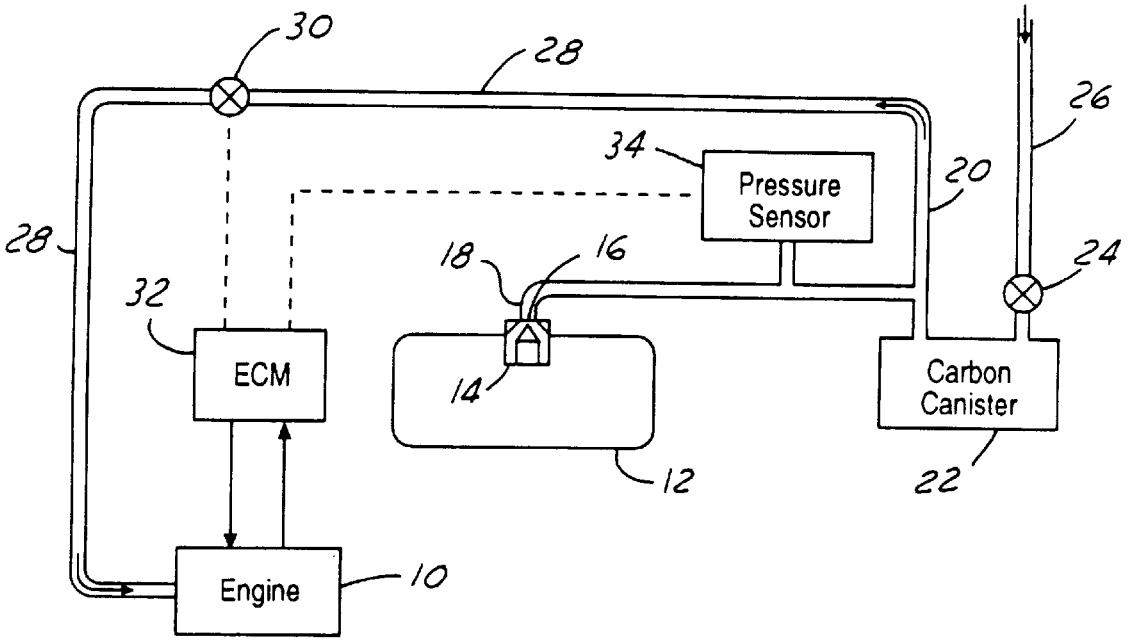
FIG. 1 is a schematic diagram of an automotive engine having a fuel vapor venting and carbon canister purging system according to the present invention.

Referring to FIG. 1, a schematic diagram of an automotive engine 10 is shown that receives liquid fuel from a fuel tank 12. Vapor generated by fuel contained within the fuel tank 12 and furnished to the engine 10 is controlled by a system according to the present invention. Vapor leaving fuel tank 12 passes through a vapor vent valve 14 and through an outlet port 16 and into a vapor line 18. The vapor then passes to a port 20 of a carbon canister 22.

When the engine is not being operated, fuel vapor is stored within the carbon canister 22. When the engine is being operated, ambient air is drawn in and through the carbon canister 22 where it mixes with the fuel vapor and carries it to the engine 10. More specifically, a canister vent valve 24 is open and ambient air is drawn through a purge air inlet 26, then through the carbon canister 22 and through the outlet port 20, through a purge line 28, past a purge valve 30 and into the engine 10. An electronic control module (ECM) 32 controls the rate of the purging by operating the purge valve 30 based on information received from a pressure transducer 34.

Air drawn through the carbon canister 22 causes desorption of fuel vapor stored in the canister. The fuel vapor and air flowing from the canister 22 are combined with additional vapors from the fuel tank 12. The system attempts to maintain equilibrium whereby the fuel tank vacuum is equal to the vapor storage canister system flow restriction, which, in turn, is a function of the purge air flow through the system.

The amount of vapor mass drawn from the fuel tank 12 is dependent upon many factors: fuel tank vapor space volume, vapor storage canister flow restriction characteristics, the amount of purge flow lost, the amount of purge flow regained, the rate at which purge flow is regained, the current volatility condition of the fuel within the fuel tank, and the rate at which the tank is allowed to vent. As the overall engine air and fuel consumption rates decrease, the magnitude of impact on engine combustion stability increases for a given influx of purge fuel vapor.

The system of the present invention utilizes the electronic control module (ECM) 32 to calculate an ideal or target vacuum that should be present in the system and compares the calculated vacuum to the actual system pressure. If the engine is determined to be in a sensitive fuel control state, i.e. low fuel consumption, the purge flow is reset and begins to slowly increase flow, thereby slowly drawing vapor from the fuel tank 12 and avoiding a rich engine condition.

The system and method of the present invention can best be described by an example of the operation of an engine as it cycles from a normal load to a heavy load and back to a normal load. FIGS. 2 through 10 represent aspects of the engine system as the engine load is cycled over time. The x-axis in each of the graphs is representative of time measured in seconds.

Figure 2:
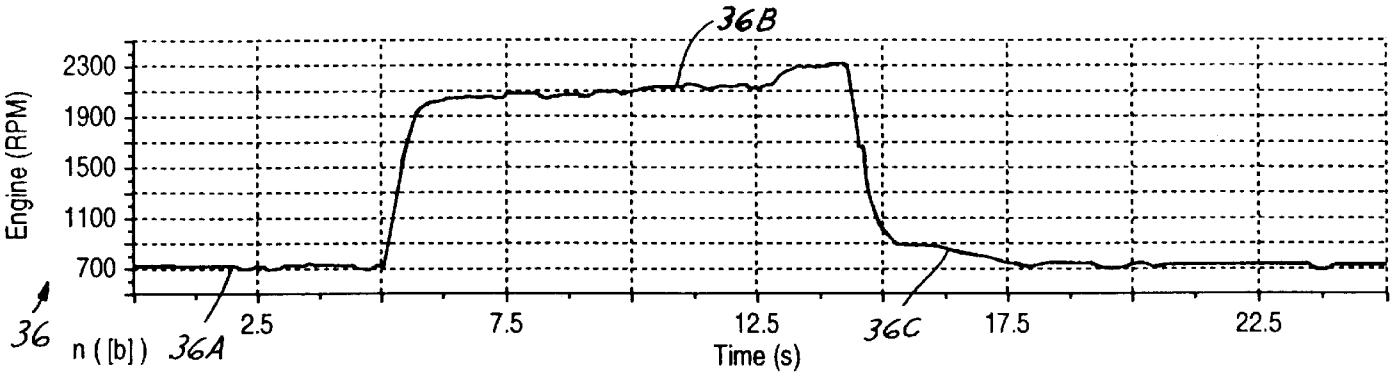
FIG. 2 is a graph of engine load in rpm's.

Referring to FIG. 2 the engine load 36, in rpm's, is shown. A normal, i.e. light to moderate, engine load 36A is shown at about 700 rpm's for a period of about five (5) seconds. After about five (5) seconds, the engine load is increased, rather rapidly to a heavy load 36B, around 2000 rpm's, and held for about ten (10) seconds. The engine load returns to normal 36C at about fifteen (15) seconds on the graph 36.

Figure 3:
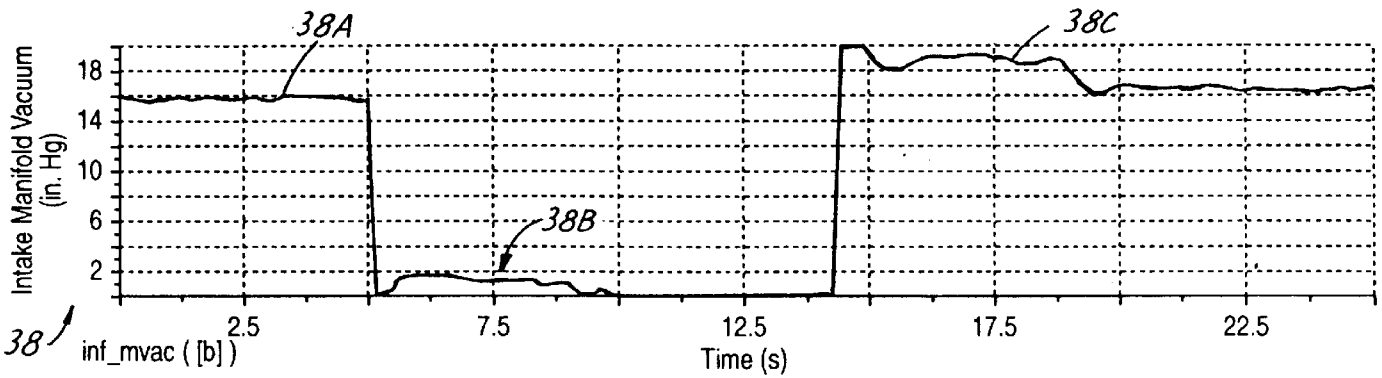
FIG. 3 is a graph of the intake manifold vacuum in inches of Mercury.

In general, FIGS. 3 through 10 are 25 graphical representations of how the system reacts to the change in engine load shown in FIG. 2. FIG. 3 is a representation of the intake manifold vacuum 38 in inches of Mercury as it corresponds to the changes in the engine load. As shown by the first five seconds of the graph in FIG. 3, a sufficient manifold vacuum 38A is produced which allows a full stable purge flow 40A shown in FIG. 4 which is a representation of the fraction of full purge flow available.

Figure 4:
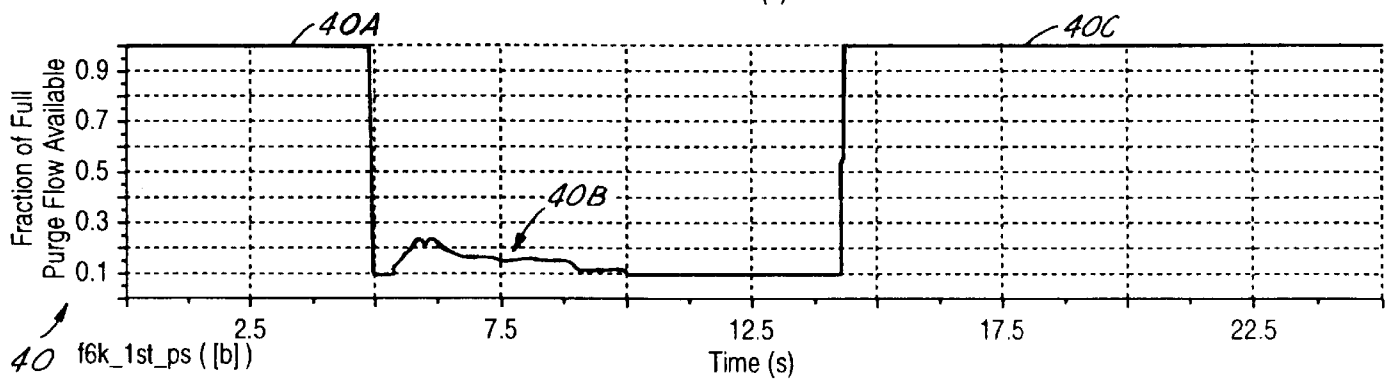
FIG. 4 is a graph of the fraction of purge flow available.

When the period of heavy engine load occurs, between five (5) and fifteen (15) seconds in 10 the present example, the manifold vacuum is reduced, shown by 38B in FIG. 3, which causes the purge flow to drop off, shown by 40B in FIG. 4. As the engine load is rapidly reduced at about fifteen (15) seconds, the manifold vacuum increases as shown by 38C in FIG. 3. The increased manifold vacuum causes the purge flow to return to full flow levels, shown by 40C in FIG. 4.

Figure 5:
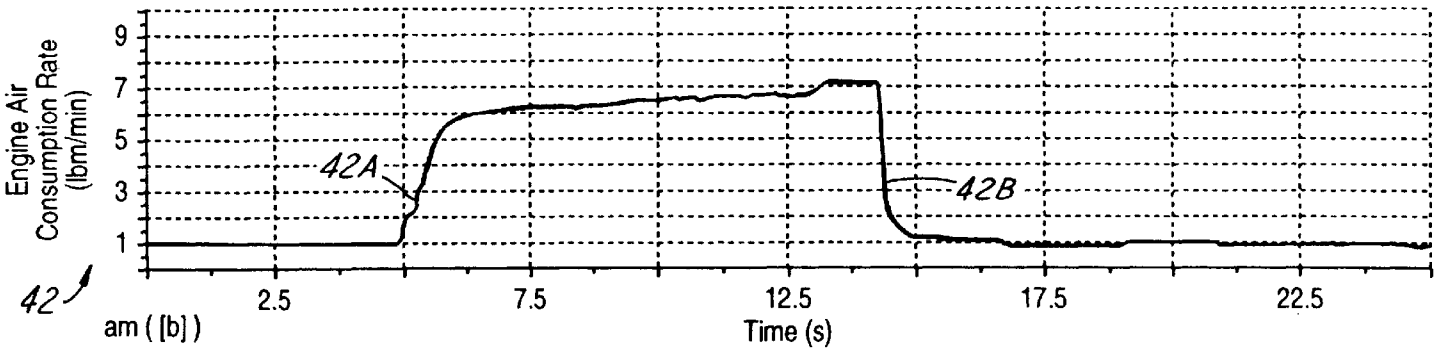
FIG. 5 is a graph of the air mass, also known as the engine air consumption rate.

FIG. 5 is a representation of the engine air consumption rate 42 that shows how the rate increases 42A relative to the increase in the engine load, and decreases 42B as the engine load decreases.

Figure 6:
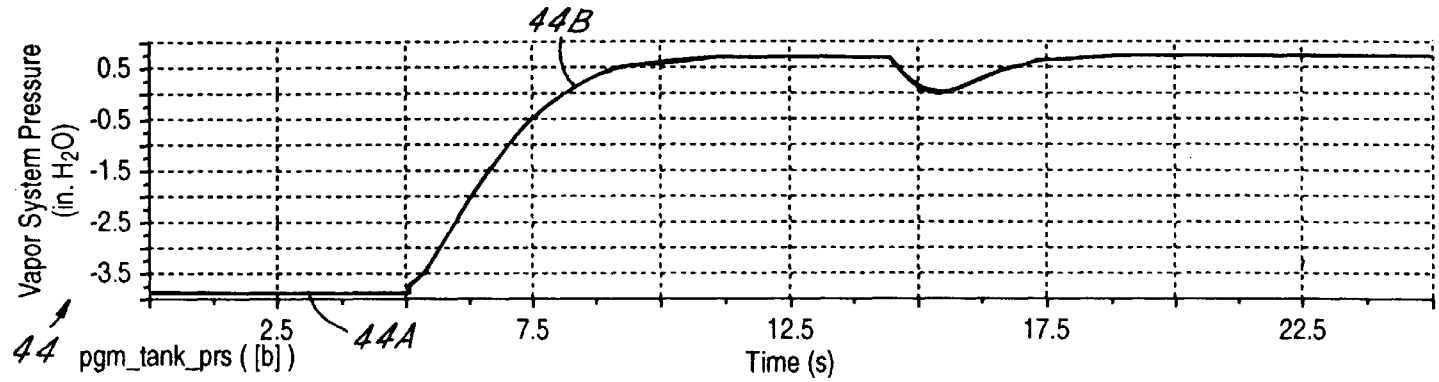
FIG. 6 is a graph of the vapor system pressure in inches of water.
Figure 7:
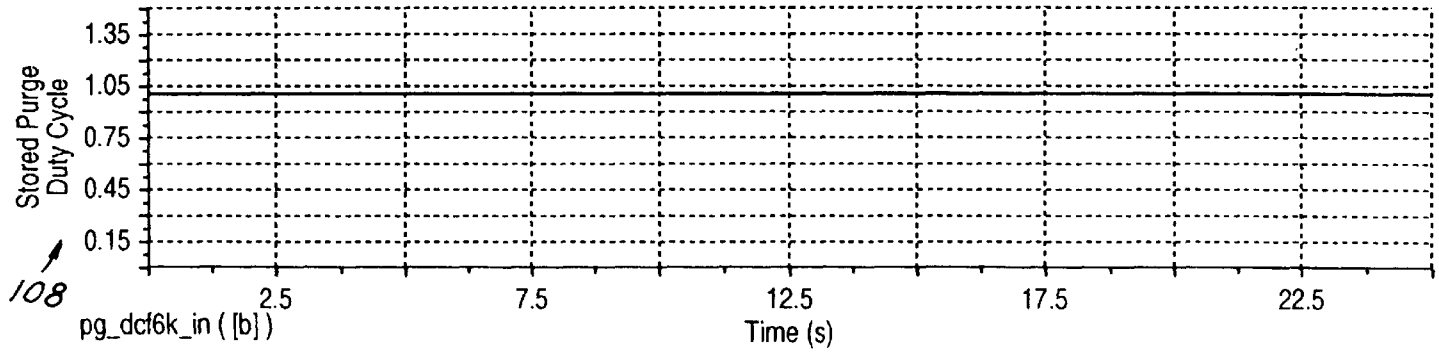
FIG. 7 is a graph of the purge duty cycle that is stored according to the method of the present invention.
Figure 8:
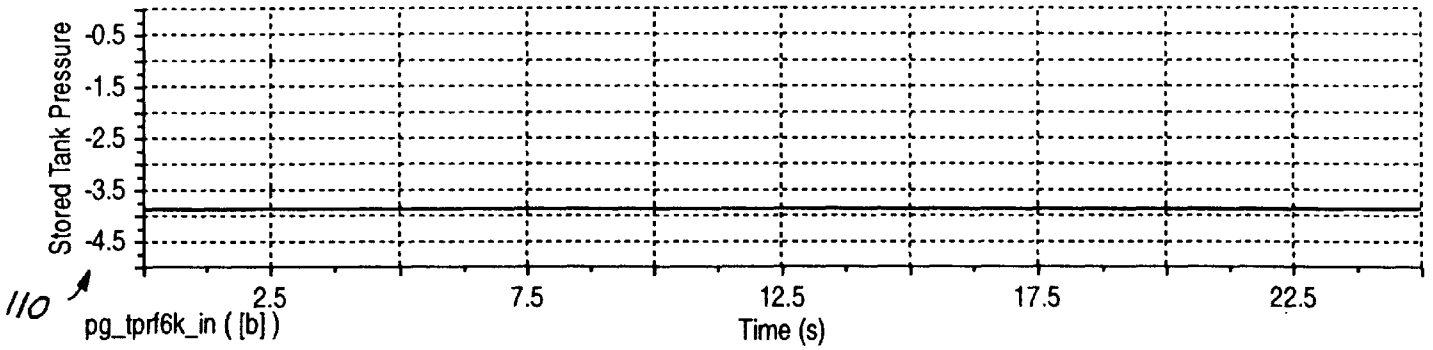
FIG. 8 is a graph of the fuel tank pressure that is stored according to the method of the present invention.
Figure 9:
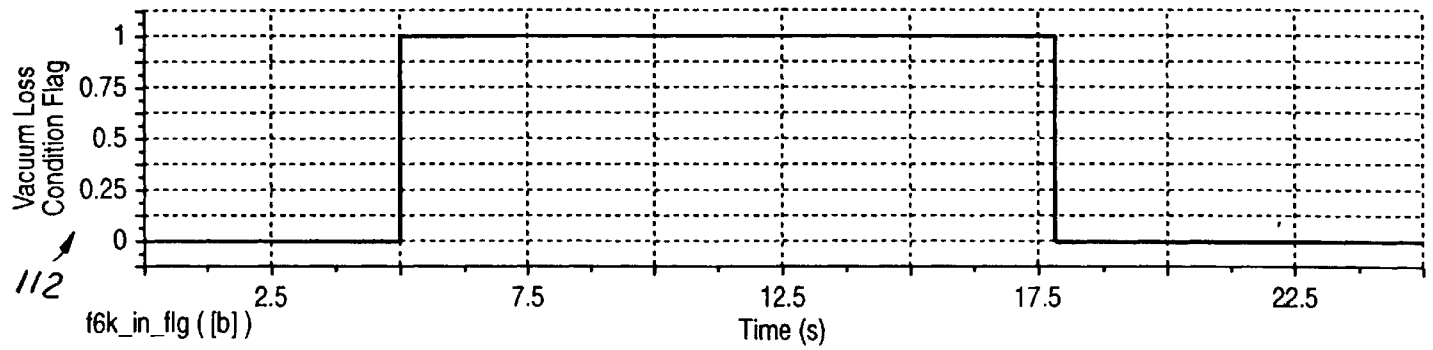
FIG. 9 is a graph of the vacuum loss condition flag as it is set and reset in the present invention.

FIG. 6 is a representation of the vapor system pressure 44, in inches of water, as it responds to changes in the engine load. The tank vacuum is in equilibrium with the canister flow restriction which results in stable vapor flow 44A being drawn from the fuel tank 12. As the reduction in purge flow restriction occurs as a result of increased engine load, air is drawn into the fuel tank to equalize the system pressure. Air in contact with the fuel in the tank generates additional vapor mass, thereby decreasing the vapor system vacuum 44B. The rapid increase in the purge flow due to the decrease in the engine load results in vapor mass quickly being drawn from the fuel tank to equalize the system pressure, potentially creating a rich engine condition if not for the system and method of the present invention.

Figure 11A:
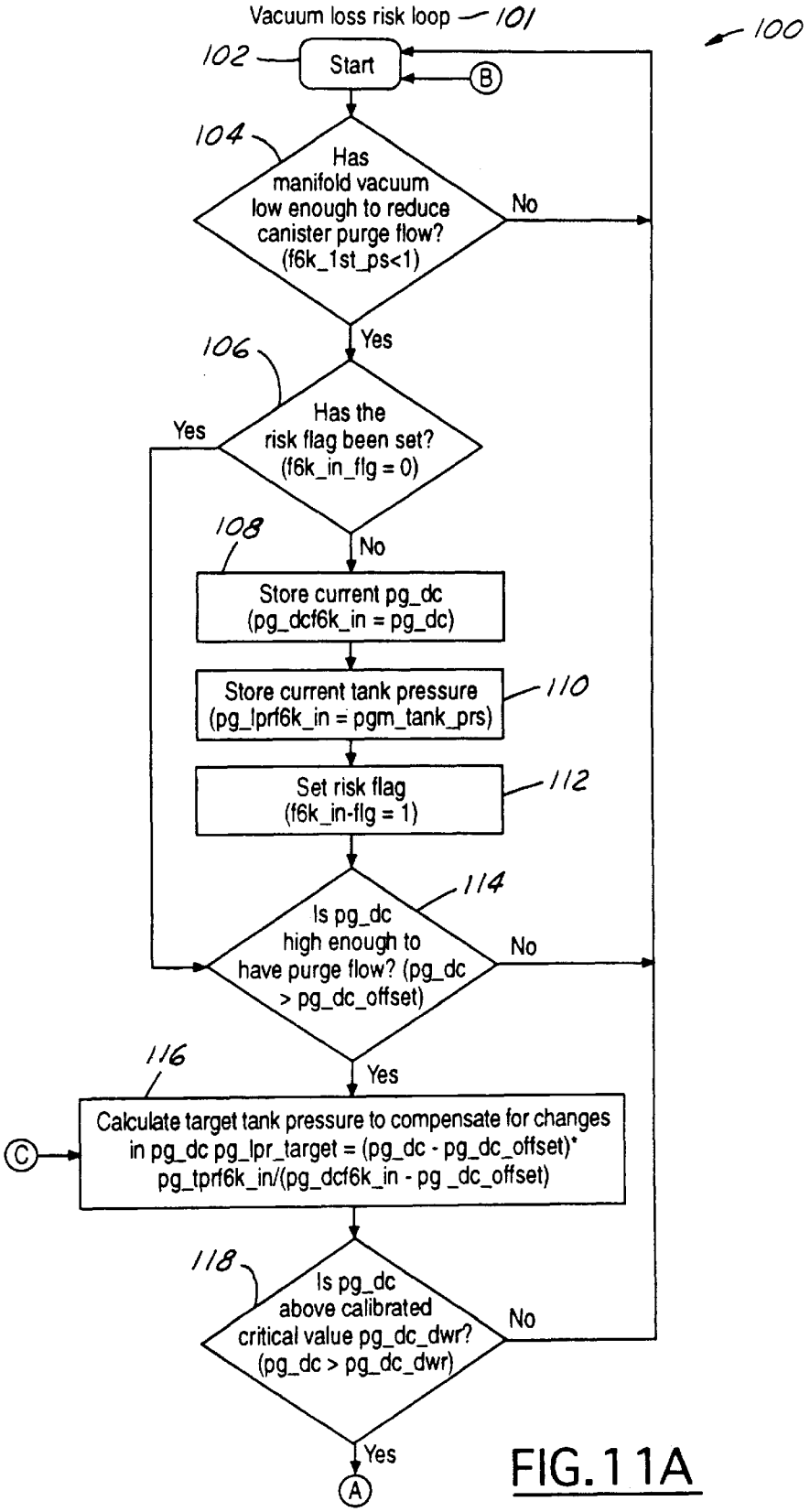
FIGS. 11A and 11B are a flow diagram illustrating the operation of the method of the present invention.

The present invention is a method 100 for identifying the point in time in which the system is at risk of vacuum loss 101 due to purge flow loss and continues to monitor the system to prevent a rich engine condition. The method 100 of the present invention is easily followed in the flow chart shown in FIGS. 11A and 11B. Referring first to FIG. 11A, the method 100 begins 102 by identifying the point at which the fraction of full purge flow available 40 becomes less than a whole 104. If it is determined that the manifold vacuum has fallen low enough to reduce the canister purge flow, the system determines if a risk flag has been set 106. If not, the system locks in the current purge duty cycle 108 (also shown in the graph in FIG. 7) and the vacuum level 110 (also shown in the graph of FIG. 8) of the system. Then the system sets the risk flag 112 (shown in the graph of FIG. 9), indicating a vacuum loss in the fuel tank has taken place and purge duty cycle and normal system pressure have been locked in.

When the flag is set 112, the system determines 114 if the current purge duty cycle is high enough to have a purge flow. If not, the system cycles back to the beginning of the vacuum loss risk loop 101.

Figure 10:
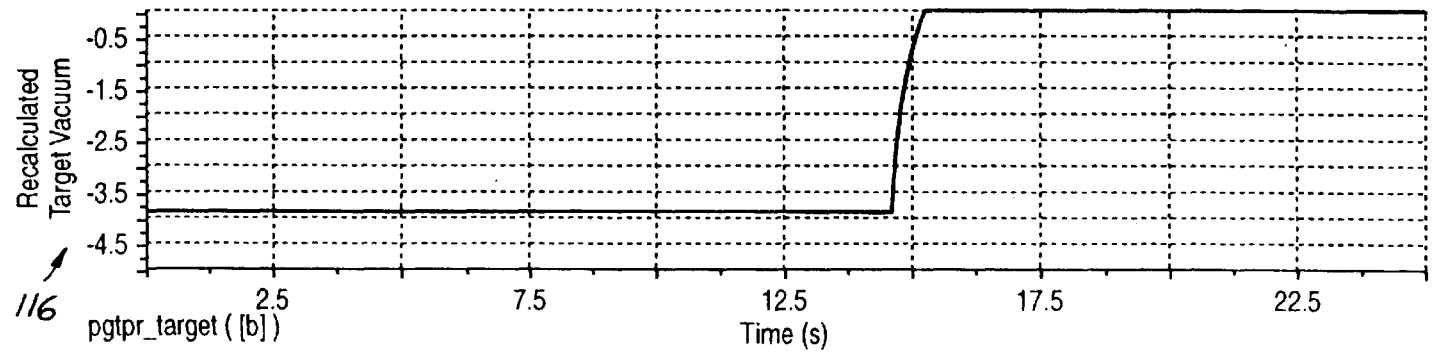
FIG. 10 is a graph of the target vacuum as it is recalculated according to the method of the present invention.

Referring again to FIG. 11A, the current purge duty cycle locked in at step 108 is compared to a predetermined calibrated purge duty cycle at step 114. If the current purge duty cycle changes the calibrated purge duty cycle, then the system calculates 116 a new target tank pressure based on the current purge duty cycle and current system vacuum levels. The target tank pressure is recalculated 116 to determine what the expected normal purge flow tank vacuum should be by multiplying the difference between the current purge duty cycle and the calibrated purge duty cycle by the current system tank pressure. The recalculated purge duty cycle is shown in the graph of FIG. 10.

Figure 11B:
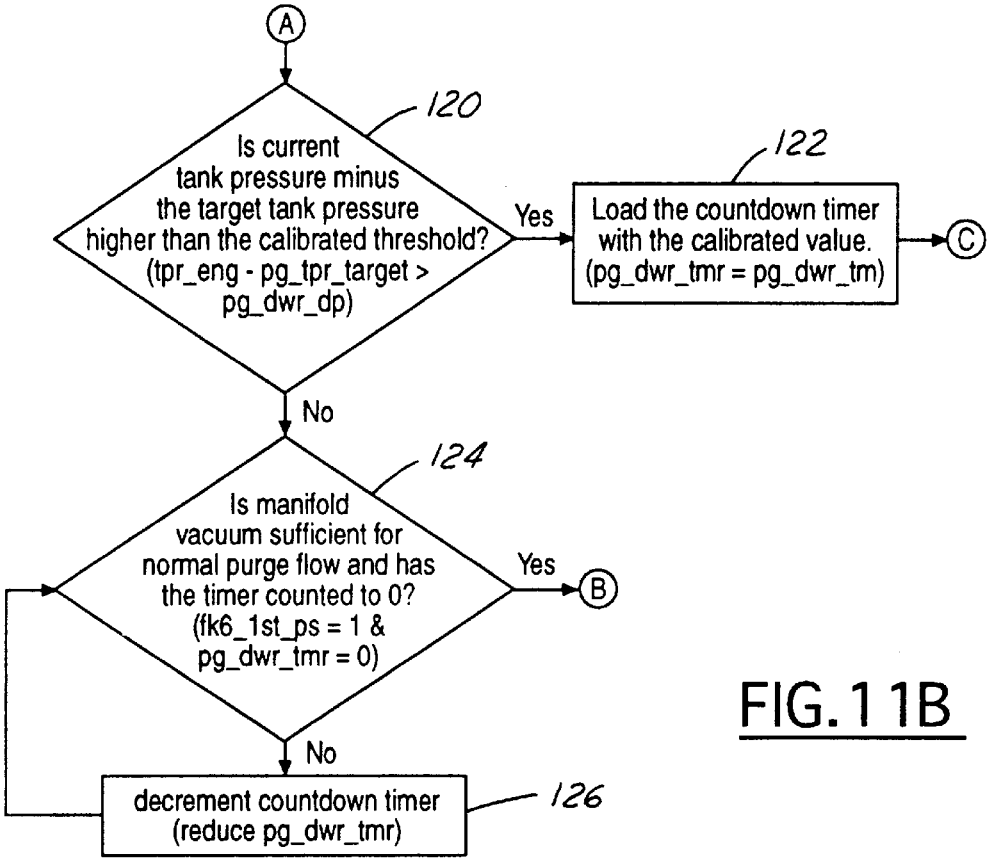

Next, the current purge duty cycle is compared to a calibrated critical purge duty cycle 118. If the current purge duty cycle is not greater then the calibrated critical purge duty cycle, the system returns to the beginning of the vacuum loss risk loop 101. Referring now to FIG. 11B, if the current purge duty cycle is greater than the calibrated critical purge duty cycle, the system calculates the difference between the actual system pressure and the target system pressure and compares 120 the target to a critical differential system pressure.

If the calculated differential pressure is greater than the critical differential system pressure and the current duty cycle is greater than a minimum threshold purge duty cycle, a countdown timer is loaded 122 and the system returns to step 116, in FIG. 11A, where a new target system pressure is calculated.

If the calculated differential pressure is not greater than the calibrated differential pressure, the system will determine if the manifold vacuum is sufficient for normal purge flow levels and, at the same time, determine if the countdown timer has reached zero 124. If both of these conditions have been met, the system will loop back to the beginning of the vacuum loss risk loop 101, in FIG. 11A. If both of these conditions are not met, the timer is decremented 126 and the system loops back to step 124.

Figure 12:
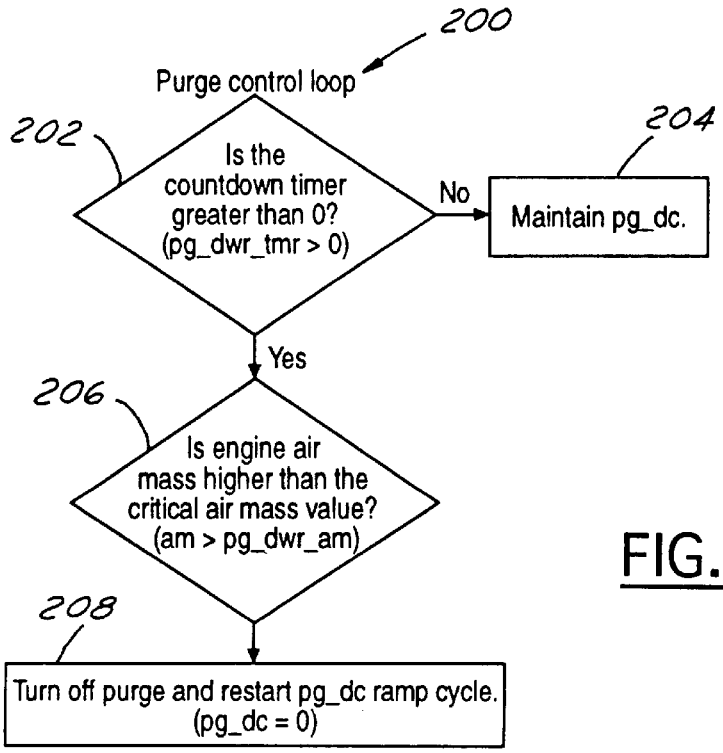
FIG. 12 is a flow diagram of the purge control loop of the present invention.

The purge control loop 200, shown in FIG. 12, determines whether or not the purge duty cycle needs to be reset and slowly ramped up to normal levels in order to prevent a rich engine condition. The purge control loop 200 is run simultaneously with the vacuum loss risk loop 101.

If normal purge flow levels have returned, and the timer has counted to zero 202, the condition flag will be reset to zero 126, and the purge flow system will function without intervention 204.

If normal flow has not been restored and the timer has not yet reached zero, the system will determine 206 if the engine air mass is lower than a critical air mass value, and if true, the system will reset the purge flow and restart a ramp cycle 208. This action stops vapor from entering the engine. The flow can be slowly restored to full flow, by way of a ramp cycle, thereby preventing an engine rich condition from occurring.

While the invention has been described in connection with a preferred embodiment, it will be understood that the invention may be changed and modified without departing from the scope of the invention as defined by the claims.

What is claimed is:

1. An evaporative emission control system for providing fuel vapor to an automotive engine, said system comprising:

a liquid fuel storage tank having an outlet port for allowing fuel vapor to exit the tank;

a carbon canister for storing fuel vapor generated within the fuel tank, with the carbon canister having an inlet port for receiving air and an outlet port, said outlet port being adapted for both receiving fuel vapor from said fuel tank and acting as an outlet for stored fuel vapor and air when said carbon canister is purged;

a vapor line connecting said tank outlet port to said outlet port of said carbon canister;

a purge valve for allowing vapor to flow from said fuel tank and said outlet port of said carbon canister through a purge line and into said engine;

a pressure transducer for sensing a purge system pressure within said vapor line; and a controller connected to said purge valve and said pressure transducer, said controller comparing a calculated differential system pressure with a predetermined calibrated differential system pressure and resetting said purge valve based on said compared differential pressures.

2. A system according to claim 1 wherein said controller begins comparing said differential pressures in the event a loss of system vacuum is identified.

3. The system according to claim 1 wherein said controller calculates a target tank pressure based on a current purge duty cycle stored in the event a risk of vacuum loss exists in said system.

4. The system according to claim 1 wherein said purge valve is reset in the event a measured air mass has dropped below a predetermined critical air mass value before a predetermined period of time has expired.

5. A method for controlling a flow of evaporative fuel vapor to an automotive engine having a liquid fuel storage tank, a carbon vapor storage canister, and a purge system for conveying fuel vapor to the engine from the fuel tank and the carbon canister, said method comprising the steps of:

identifying a risk of vacuum loss in the fuel tank;

storing a current purge duty cycle and a current tank pressure;

calculating a differential system pressure;

comparing said differential system pressure to a predetermined calibrated differential system pressure; and adjusting said flow of purged vapor to said engine in the event that said calculated differential pressure drops below said predetermined calibrated differential pressure and a measured air mass value drops below a predetermined critical air mass value before a predetermined period of time has expired.

6. The method as claimed in claim 5 wherein said step of calculating a differential pressure further comprises calculating a target tank pressure based on said stored purge duty cycle.

7. The method as claimed in claim 5 wherein said step of adjusting said flow of fuel vapor further comprises the step of loading a countdown timer in the event said calculated differential pressure remains greater than said predetermined calibrated differential pressure.

* * * * *